US006640606B1

(12) United States Patent
Volka

(10) Patent No.: US 6,640,606 B1
(45) Date of Patent: Nov. 4, 2003

(54) ALL-PURPOSE PRESSING-BENDING MACHINE

(76) Inventor: Martine Volka, Via Meloria, 14 Milan (IT), 20148

( * ) Notice: Subject to any disclaimer, the term of this patent is extended or adjusted under 35 U.S.C. 154(b) by 0 days.

(21) Appl. No.: 09/743,775

(22) PCT Filed: Jul. 23, 1999

(86) PCT No.: PCT/IT99/00234

§ 371 (c)(1),
(2), (4) Date: Jan. 12, 2001

(87) PCT Pub. No.: WO00/06318

PCT Pub. Date: Feb. 10, 2000

(30) Foreign Application Priority Data

Jul. 27, 1998 (IT) ..... MI98A0173

(51) Int. Cl.[7] ..... B21J 9/18; B21F 1/00; B21D 7/02

(52) U.S. Cl. ..... 72/452.4; 72/384; 72/447; 72/449; 140/105

(58) Field of Search ..... 72/384, 404, 446, 72/447, 449, 452.4, 452.7; 140/105

(56) References Cited

U.S. PATENT DOCUMENTS

| | | | | | |
|---|---|---|---|---|---|
| 3,052,277 | A | * | 9/1962 | Stegmann | 72/380 |
| 4,580,329 | A | * | 4/1986 | Bihler et al. | 72/449 |
| 4,581,917 | A | * | 4/1986 | Moriyama et al. | 72/446 |
| 4,607,517 | A | * | 8/1986 | Finzer et al. | 72/449 |
| 4,696,178 | A | * | 9/1987 | Bihler et al. | 72/384 |
| 4,773,250 | A | * | 9/1988 | Miyazaki | 72/446 |
| 4,862,717 | A | * | 9/1989 | Dolliner | 72/447 |
| 5,301,410 | A | * | 4/1994 | Finzer | 72/446 |
| 5,996,392 | A | * | 12/1999 | Garth | 72/452.4 |

FOREIGN PATENT DOCUMENTS

WO WO 87/04954 * 8/1987

* cited by examiner

*Primary Examiner*—David B. Jones
(74) *Attorney, Agent, or Firm*—Hedman & Costigan, P.C.

(57) ABSTRACT

The application relates to an all-purpose pressing-bending machine having a feeding device (11) for feeding a material to be bent to a plurality of bending tool supporting slides (5), associated with a supporting plate (2). At least one of the bending tool supporting slides (5) can be operated independently from the other slides by a corresponding motor-reducing unit (6), each of the motor-reducing units being coupled to an electronic control device.

4 Claims, 5 Drawing Sheets

ALL-PURPOSE PRESSING-BENDING MACHINE

BACKGROUND OF THE INVENTION

The present invention relates to an all-purpose pressing-bending machine.

Prior pressing-bending machines conventionally comprise a feeding or supplying system, including a single central gear wheel, for feeding the material to be bent, operating the press and driving the mechanical slides provided for bending said material.

In particular, the mechanical slides are provided with a plurality of cams for translating a rotary movement derived from the central gear wheel into a translation movement on the piece to be bent.

This system, however, is affected by a first drawback due to the fact that the driving of the cams is derived from the central wheel movement, thereby for each type of machining a specific cam set would be required.

This, as it should be apparent, would involve a comparatively high time for properly equipping the machine, thereby negatively affecting the cost and product making time.

A further problem of prior pressing-bending machines is that the designing of a novel type of machining would be very fatiguing and expensive since, to that end, it would be necessary to design again a novel specific set of cams.

SUMMARY OF THE INVENTION

Accordingly, the aim of the present invention is to provide an all-purpose pressing-bending machine having very good operating features, and obviating the above mentioned drawbacks.

The above mentioned aim, as well as yet other objects, which will become more apparent hereinafter, are achieved by the present invention which specifically relates to an all-purpose pressing-bending machine, comprising a plurality of bending tool supporting slides, coupled to a supporting plate, and feeding means for feeding a material to be bent, characterized in that at least one of said bending tool supporting slides can be operated independently from the other slides by a corresponding motor-reducing unit, each said motor-reducing unit being coupled to electronic control means.

According to a preferred embodiment of the present invention, with each bending tool supporting slide a single cam pair is associated, each cam of said cam pair being adapted to translate a rotary movement of the motor into a translation movement of the bending tool supporting slide, said cam pairs being each formed by universal cams offset of 180° from one another.

According to another preferred embodiment of the present invention, the translation movement of the bending tool supporting slide is obtained by modifying the time evolvement of the current circulating through the respective motor.

According to another preferred embodiment of the present invention, the feeding means for feeding said material to be bent comprise a roller feeding assembly which is driven by independent driving means and has a programmable operating pitch.

According to a further embodiment of the present invention, the machine comprises a programmable central core, which is independently driven, arranged at the center of the bending tool supporting slide supporting plate, and having a longitudinal movement with respect to said supporting plate for ejecting a workpiece or for sequentially driving the bending abutment core.

According to yet another preferred embodiment of the present invention, the all-purpose pressing-bending machine comprising a press, arranged upstream of said bending tool supporting slides and outside of the operating circumference thereof, said press being provided with a driving motor which is independent from the motor reducing units coupled to said bending tool supporting slides.

In particular, the press comprises a D.C. motor, cooperating with a braking-clutching device, which can be remotely controlled, and with a "one-shot" device, thereby affording the possibility of performing different types of machining cycles.

Moreover, the press is provided with an independent drive along an axis having a direction substantially parallel to the material being processed feeding direction.

Finally, the machine electronic control means comprise an axis driving card receiving data from a processor included in a PC and operating on the motors driving the different components of the machine in order to provide a desired machining or working program.

The invention provides the following advantages with respect to the prior art status.

At first, since the programmable driven slides are independently driven, it is possible to accurately control the bending tool stroke and speed by using a PC, without mechanically controlling the cams.

The machining of different types of products can be simply obtained by replacing the tool acting on the strip or wire, with a consequent very reduced time for properly setting the machine.

Moreover, the component number is greatly reduced, since the above disclosed prior motion transmitting system is herein omitted.

The independent driving of the press would allow to fully exploit the characteristics of the motor, which can be controlled in a very simple manner by a PC, since it is independent from the remaining part of the machine.

Moreover, the motor driving of the press would allow said press to be arranged outside of the operating circumference of the slides and, moreover, it would afford the possibility of not using the press, as it would not be necessary.

Furthermore, the press motor driven longitudinal axis would allow to easily assemble the molds always at the center of the press, thereby obviating the requirement of performing complex adjusting operations and improving the life of the mold, since any longitudinal stress due to an improper location of the mold in side the press are fully eliminated.

Moreover, the use to of a PC would allow to easily control the longitudinal displacement for properly centering the mold as well as the cross displacement for pressing the workpiece, by timing the press operation with the remaining operations of the machine.

Finally, the programmable pitch roller feeding of the strip or wire being processed is such as to provide an adjustable stroke, which is different from a fixed stroke as in prior mechanical feeding devices.

Actually, even if manually performed, a cross location of the feeding assembly would allow the material to be always accurately centered with respect to the following machining tools, press, slide and so on.

The PC moreover also manages the feeding and timing with the other tools included in the machine.

BRIEF DESCRIPTION OF THE DRAWINGS

Further advantages and characteristics of the, present invention will become more apparent hereinafter from the following detailed disclosure, given by way of an illustrative but not limitative example, and with reference to the accompanying drawings, where.

DESCRIPTION OF THE PREFERRED EMBODIMENTS

In the following disclosure reference will be made to a preferred embodiment of the present invention which has been illustrated as a not limitative example of several possible variations thereof.

Figure 1:
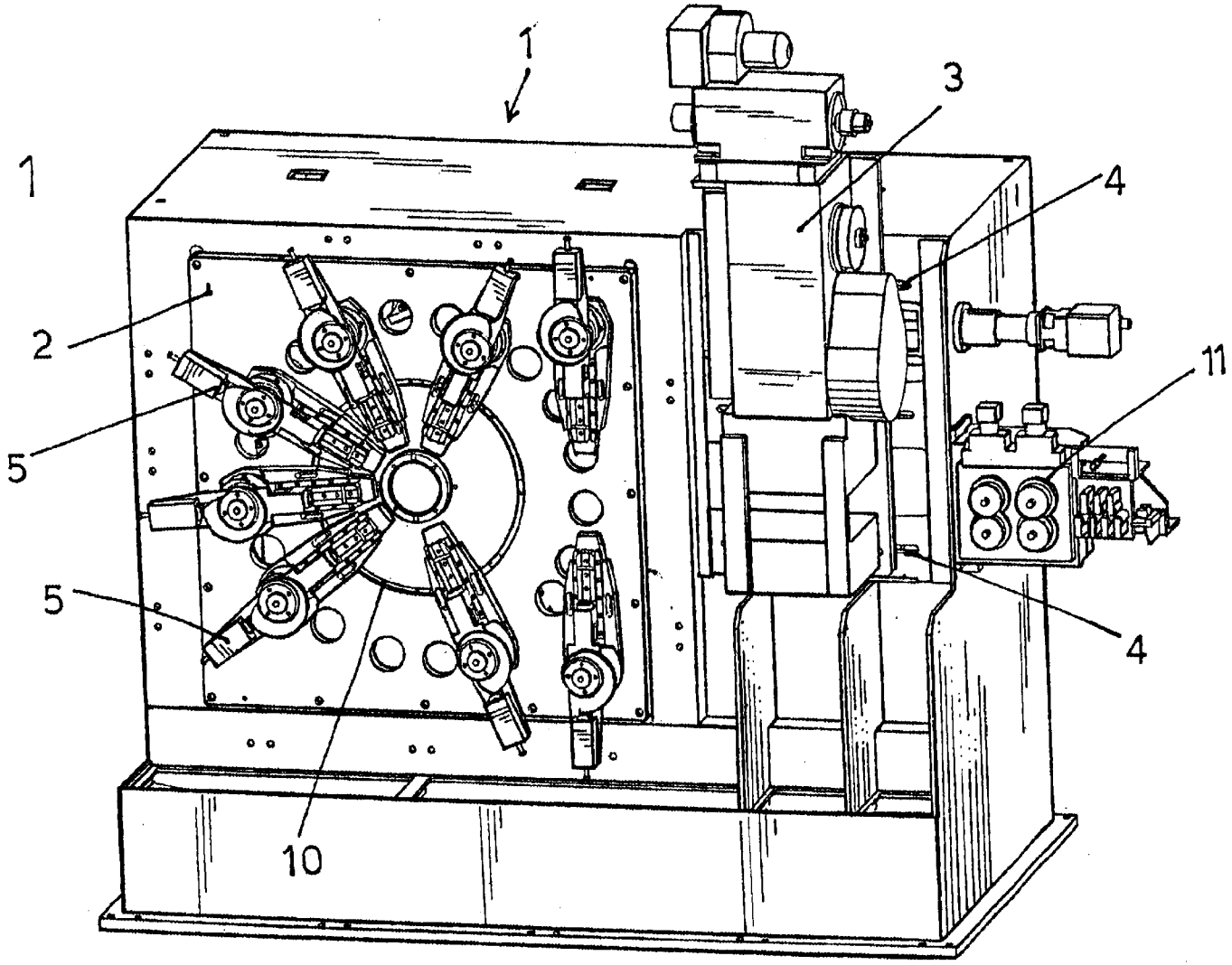
FIG. 1 is a perspective view of the pressing-bending machine according to the present invention.
Figure 2:
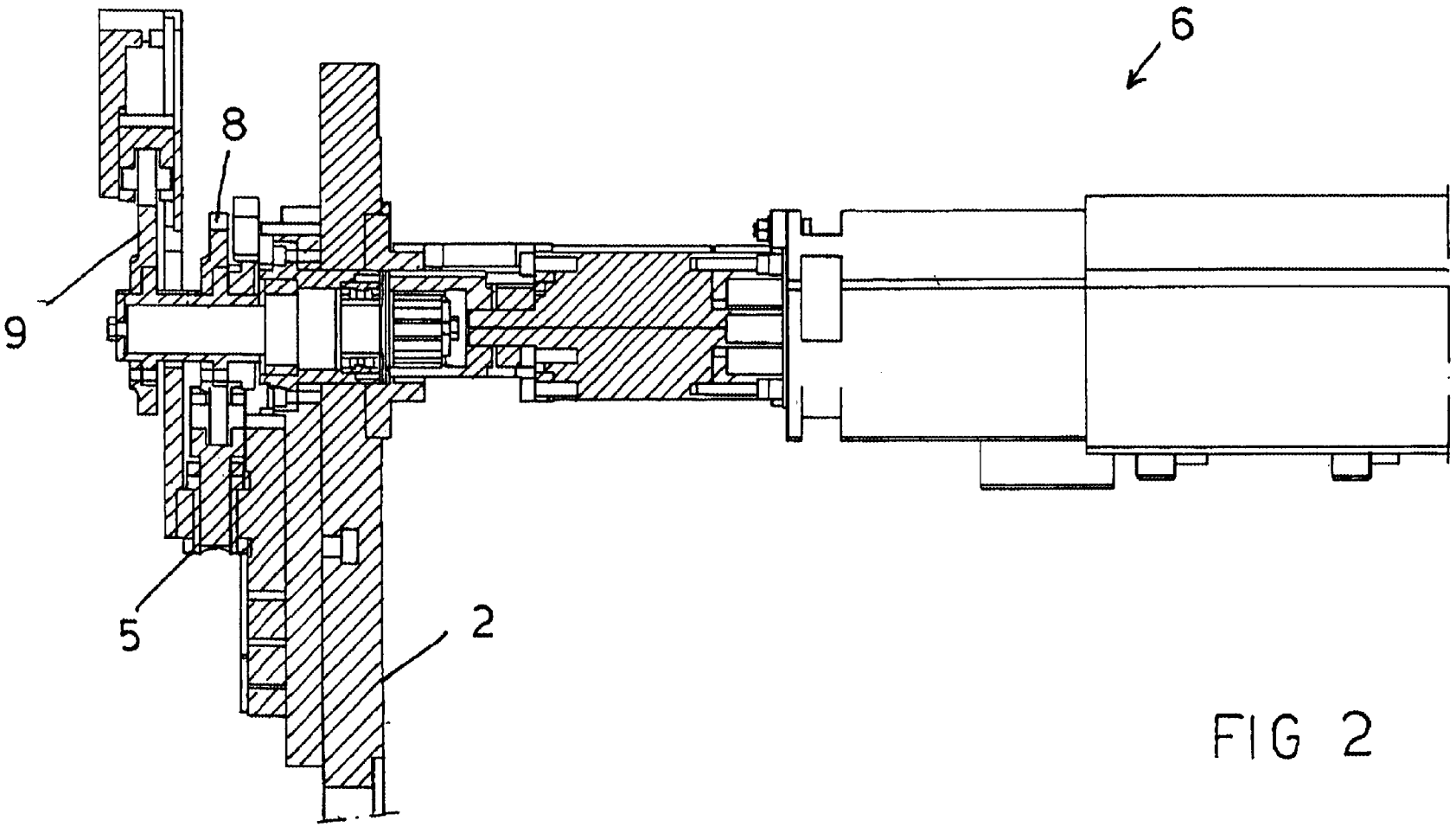
FIG. 2 is a partially cross-sectioned view of a motor reducing unit included in the machine of FIG. 1, and of the slide associated therewith.
Figure 3:
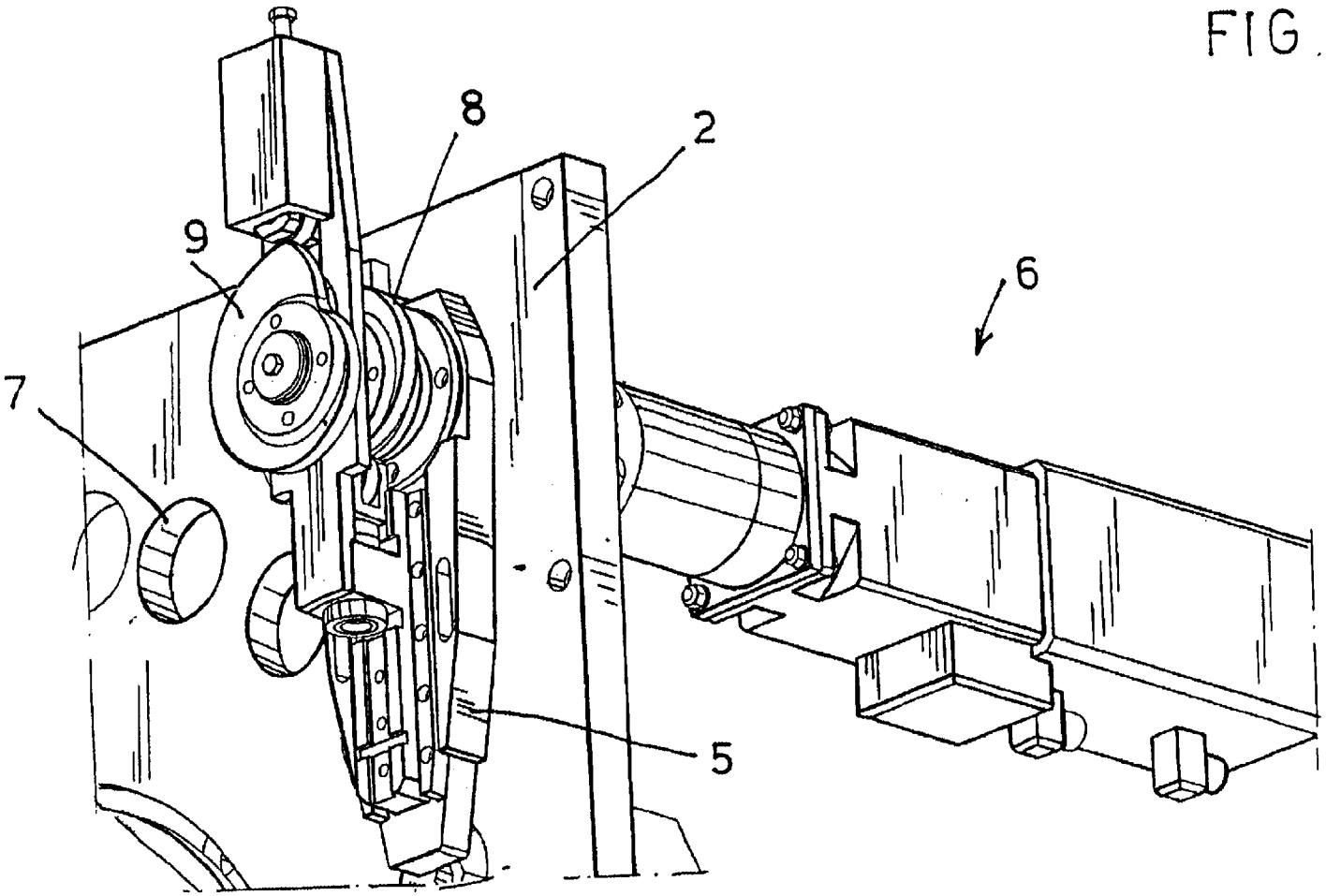
FIG. 3 is a further perspective view of the motor reducing unit and the slide associated therewith as shown in FIG. 2, as assembled on a supporting plate of the inventive machine.

FIG. 1 illustrates the all-purposes pressing-bending machine according to the present invention, as generally indicated by the reference number 1.

The machine 1 comprises a plurality of bending tool supporting slides 5, each of which is coupled to a hole 7 formed in a supporting plate 2.

Each of said bending tool supporting slides is driven independently from the other slides by a corresponding motor-reducing unit 6; moreover, the motor-reducing units 6 can be properly programmed in order to adjust the operating stroke and speed of the bending tool.

Preferably, the motor-reducing unit herein used is a precision epicycloidal motor reducing unit, the reduction ratio being selected based on the desired yield capability and power features.

Moreover, with each bending tool supporting slide 5 is associated a single cam pair, the cam pairs being respectively indicated by the reference numbers 8 and 9, provided for translating the rotary motion of the motor into a translation motion, in the two directions, of the bending tool supporting slide 5.

Preferably, each cam pair is constituted by universal cams 8 and 9 which are offset from one another of 180°.

Thus, in order to drive a bending tool supporting slide 5, it is necessary to merely change the time evolvement of the current circulating through the motor.

The material to be bent is fed or supplied to the bending tool supporting slide assembly by a roller feeding assembly 11, which is driven independently from the remaining part of the machine and is provided with a programmable pitch.

Figure 4:
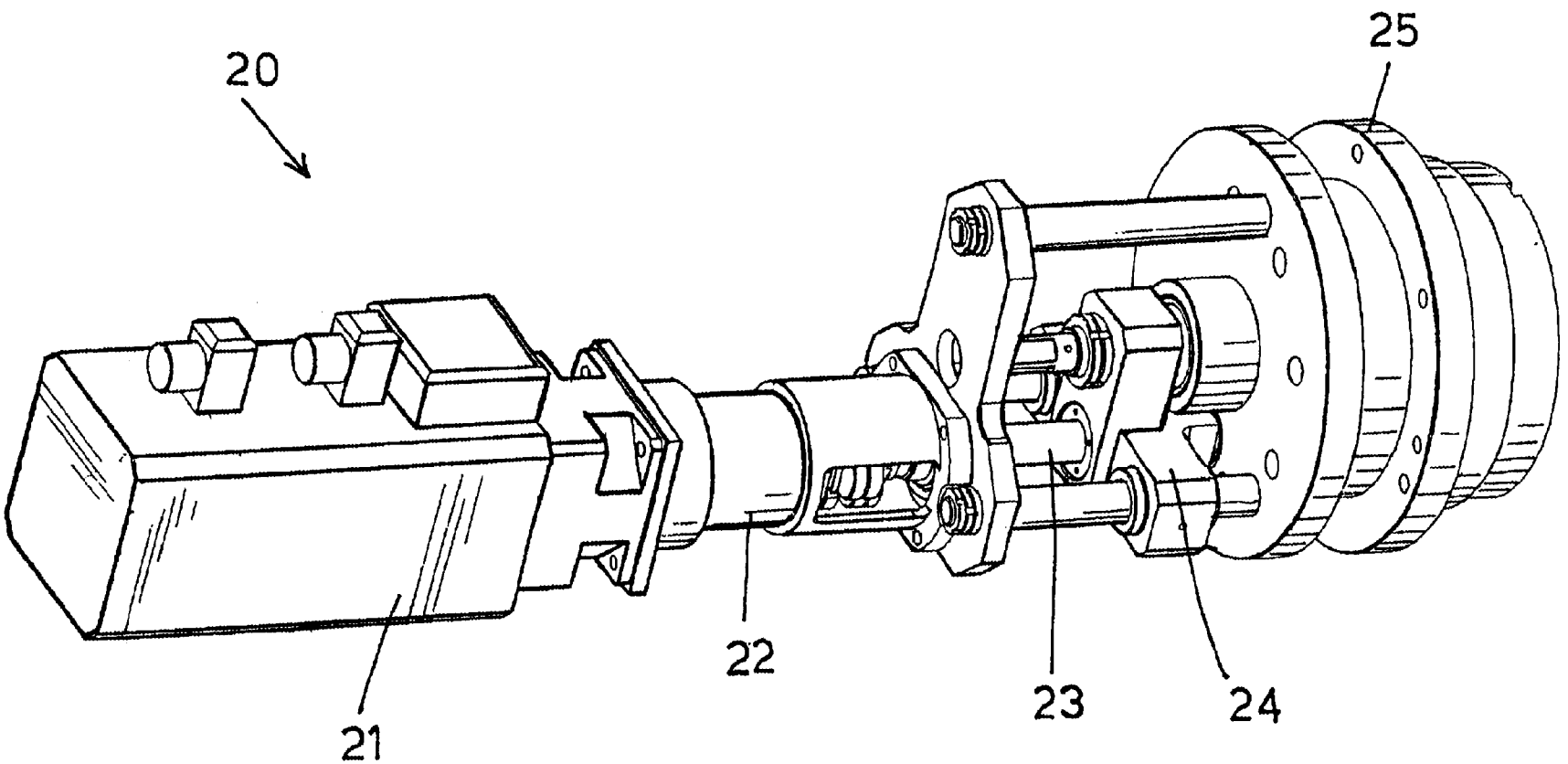
FIG. 4 is a further perspective view of a central motor driven core, used for ejecting a workpiece.
Figure 5:
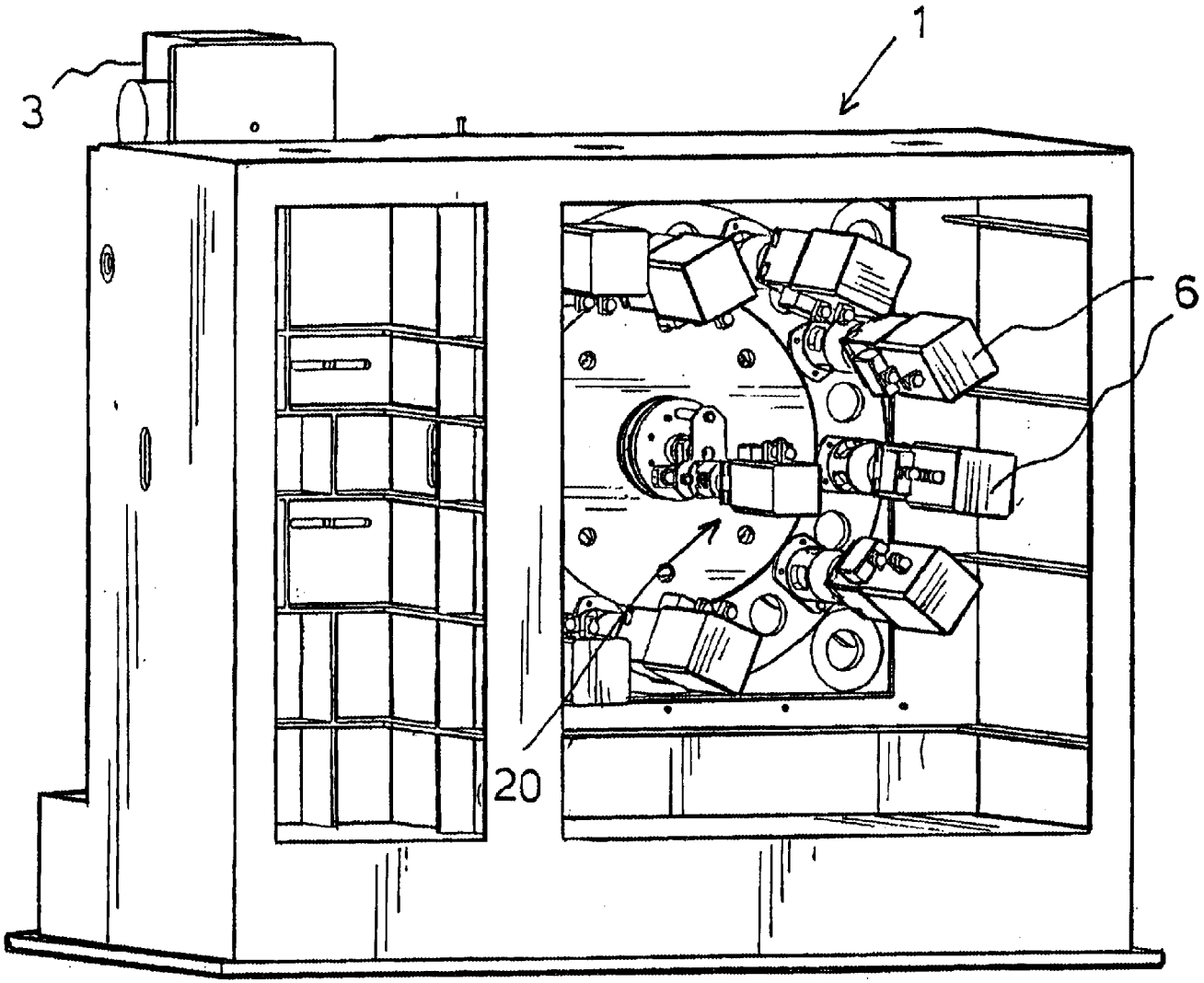
FIG. 5 is a further perspective view of a rear portion of the machine shown in FIG. 1.

The machine 1 comprises moreover a programmable central core, generally indicated by the reference number 20 in FIG. 4, which is independently driven by the driving motor 21 in turn coupled to the motor reducing unit 22.

The driven core 20 is arranged at the center of the supporting plate 2, and is coupled to the latter by a flange 25.

In particular, said driven core 20 is adapted to be longitudinally driven and, accordingly, is used for ejecting the workpiece or for sequentially driving the bending counter-abutment core.

Differently from the prior art status, in which the driving of said core is controlled by a pair of cams which are specifically designed for a workpiece to be made, and which are driven by the above mentioned central wheel, in the present invention the longitudinal displacement is controlled by a ball recirculating screw 23-nut screw assembly, associated to a transmission coupling 24, which is turned by the motor assembly 20 and reducing unit 21, under the control of a PC, provided for adjusting the operating speed and displacement thereof based on the same principle as the programmable slides 5.

The all-purposes pressing-bending machine 1 according to the present invention comprises, moreover, a press 3, arranged upstream of the bending tool supporting slides 5 and outside of the operating circumference 10 of said bending tool supporting slides 5.

The press 3 is provided with a dedicated motor which is independent from the motor reducing units 6; moreover, the press 3 is independently driven along an axis which is substantially parallel to the material being processed feeding direction, thereby said press can be displaced or driven along the guides 4.

The press 3 comprises moreover a D.C. motor, cooperating with a braking-clutching device, which can be remotely controlled, as well as with a one-shot device, to perform different types of machining operations.

More specifically, the press 3 can perform a step-by-step operating cycle in which it will operate with a reduced speed and in which the braking-clutching assembly, as telecontrolled by the operator, will allow the mold to be properly located and adjusted on the working table of said press.

A second mode of operation of the press 3 is a single cycle type of operation.

In this mode of operation, the provision of the one-shot device will allow, both in a manual cycle and in an automatic continuous cycle, to perform a single full pressing at a constant rate which can be adjusted by changing the D.C. motor speed.

A further operation mode of the press 3 would be a continuous cycle type of operation.

In this mode of operation, the possibility of continuously changing the D.C. motor would allow to automatically modify the production rate of the press by fitting it to the operating rate of the remaining toolings.

As above mentioned, the press 3 is provided with a motor driven longitudinal axis allowing the molds to be always assembled at the center of the press 3, thereby reducing to a minimum the required time and providing a longer life for the mold.

The PC will also control the longitudinal displacement for centering the mold as well as the cross displacement for molding the workpiece, by timing the operation of the press with the remaining portions of the machine.

The machine 1 is electronically controlled by an axis controlling card, receiving the necessary data from a processor of a PC and operating the different motors of the machine 1 to provide a desired machining program.

More specifically, depending on the type of movements to be performed and on the control types to be obtained, different position transducers or sensors would be used such as: an incremental encoder on the shaft of the motor for feeding the strip for reading the strip length, a further incremental encoder on the crankshaft of the press 3 for reading the stroke thereof, a further incremental encoder on the shaft of the motor for horizontally locating the press 3 and a further incremental encoder on the pinion of each slide 5 in order to read the angular position of the cams 8 and 9.

All of the mentioned encoders would be virtual encoders, since they would be simulated by several power drives of the respective motors.

The machine according to the present invention operates as follows.

Considering that the installation of a motor reducing unit 6 on the pinion of each said bending tool supporting slides 5 would render each slide independent from the other and fully controllable, it should be apparent that this system would allow to machine a workpiece by simply modifying the time evolvement of the current circulating through the motor, by causing each tool supporting slide 5 to be driven with a front to back movement by performing the same movement as a slide driven by a conventional type of cam system.

Thus, it will be possible to obtain a very flexible mode of operation, at a comparatively high speed, of about 80–100 shots by minute.

Thus, the conventional cam pair series for different products have been replaced by a single cam pair, of an all-purpose type, which can be used for different products.

In this connection it is to be pointed out that the time variation of the operating stroke is obtained by controlling the motor by causing it to accelerate or decelerate at set time instants.

From the above disclosure of the several portions of the machine 1 it should be apparent that the subject machine is very simple construction-wise and flexible in operation.

The replacement of the machine tools would be limited to the replacing of the machining knives and slides, by properly arranging said slides in their seats on the supporting plate, the selection of the product being obtained by loading a proper program held in the PC.

From the above it should be apparent that the invention fully achieves the intended aim and objects.

What is claimed is:

1. All-purposes pressing bending-machine, for pressing-bending a material being fed to said machine along a feeding direction, wherein said machine comprises an upstream press having a press driving motor, and a plurality of downstream bending tool supporting slides, coupled to a supporting plate, and roller feeding means for feeding said material to be bent, each of said downstream bending tool supporting slides being driven independently from the other slides by a corresponding geared-motor unit, each of said units being coupled to electronic control means, each of said downstream bending tool supporting slides being fixedly coupled to a single pair of cams for translating a rotary motion of each said geared motor units into a translation motion of each of said slides, each said cam pair including two all-purposes cams, offset from one another by 180°, each said geared-motor unit being an epicycloidal geared-motor unit, said machine further comprising an independently driven programmable central core coupled to a center of said supporting plate by a coupling flange and longitudinally driven with respect to said supporting plate by a recirculating ball screw-nut assembly for ejecting a workpiece or for sequentially driving a bending counter-abutment core.

2. A machine according to claim 1, wherein said press is arranged outside of an operating circumference of said bending tool supporting slides, said press driving motor being independent from that of each said geared motor unit, said press further comprising a D.C. motor, cooperating with a remotely controllable brake-clutching device and with an one-shot device, so as to perform different types of machining operating cycles, said press driving motor independently driving said press along an axis which is substantially parallel to said material feeding direction.

3. A machine according to claim 1, wherein said electronic control means comprise an axis driving card receiving driving data from a PC and a plurality of virtual encoders comprising a first incremental encoder on a shaft of a motor for feeding said material, a second incremental encoder on a crankshaft of said press, a third incremental encoder on a shaft of said press driving motor and a fourth incremental encoder on a pinion of each said slide to read an angular position of said two cams of said cam pair.

4. A machine according to claim 1, wherein said roller feeding means are independently driven with a programmable pitch.

* * * * *